US005677844A

United States Patent [19]

Kubo

[11] Patent Number: 5,677,844

[45] Date of Patent: Oct. 14, 1997

[54] METHOD FOR NUMERICALLY PREDICTING CASTING DEFECTS

[75] Inventor: Kimio Kubo, Minami-Kawachi-machi, Japan

[73] Assignee: Hitachi Metals, Ltd., Tokyo, Japan

[21] Appl. No.: 620,380

[22] Filed: Mar. 22, 1996

[30] Foreign Application Priority Data

Mar. 24, 1995 [JP] Japan ..... 7-091849

[51] Int. Cl.[6] ..... G06F 19/00

[52] U.S. Cl. ..... 364/472.02; 164/451; 364/475.09

[58] Field of Search ..... 364/468.01, 468.03, 364/468.04, 468.24, 472.02, 472.03, 475.02, 475.09; 164/4.1, 451, 452, 457, 6, 7.1, 154.1, 155.1, 255

[56] References Cited

U.S. PATENT DOCUMENTS

| | | | |
|---|---|---|---|
| 5,031,108 | 7/1991 | Fujita et al. | 364/475.02 |
| 5,097,432 | 3/1992 | Harada et al. | 364/475.07 X |
| 5,227,979 | 7/1993 | Fukuhira et al. | 364/475.02 |
| 5,377,119 | 12/1994 | Backer et al. | 364/472.02 |

FOREIGN PATENT DOCUMENTS

| | | |
|---|---|---|
| 61-193766 | 8/1986 | Japan . |
| 4-220137 | 8/1992 | Japan . |

OTHER PUBLICATIONS

K. Kubo et al., "Mathematical Modeling of Porosity Formation in Solidification", Metallurgical Transactions B, vol. 16B, Jun. 1985, pp.359–366.

*Primary Examiner*—Joseph Ruggiero

*Attorney, Agent, or Firm*—Finnegan, Henderson, Farabow, Garrett & Dunner

[57] ABSTRACT

The occurrence of porosity defects in solidifying metal can be predicted by a computer simulation numerically analyzing the solidification process of molten metal comprising (1) dividing a mold and a mold cavity into a plurality of elements; (2) providing each of the elements with material properties of casting metal and mold, and process variables as initial data; (3) calculating a liquid fraction of each of the elements in successive predetermined time increments to examine whether nor not each of the elements is in solid-liquid coexisting zone; (4) calculating pressure gradients between each of elements in the solid-liquid coexisting zone and neighboring elements thereof by numerically analyzing an interdendritic flow of the molten metal; (5) calculating gas pressure in the molten metal in each of elements in the solid-liquid coexisting zone; (6) comparing the gas pressure with an equilibrium pressure, and calculating a porosity amount for each of elements where the gas pressure is higher than the equilibrium pressure; and (7) repeating the calculations of the steps (3) to (6) until the solidification of the molten metal is completed. Since the above method takes the effects of interdendritic flow of molten metal into consideration, the occurrence of porosity defects can be predicted accurately and directly.

6 Claims, 10 Drawing Sheets

(Nitrogen Content: 60 ppm)

(Nitrogen Content: 60 ppm)

(Nitrogen Content: 60 ppm)

(Nitrogen Content: 70 ppm)

(Nitrogen Content: 70 ppm)

(Nitrogen Content: 70 ppm)

METHOD FOR NUMERICALLY PREDICTING CASTING DEFECTS

BACKGROUND OF THE INVENTION

The present invention relates to a method for optimizing casting parameters by computer simulating solidification process of a molten metal taking the growth process of porosity formation into consideration, thereby enabling the production of a cast article free from porosity defects.

A common practice used to manufacture a shaped metallic article includes a casting process, wherein a molten metal is poured into a mold cavity of a desired shape, solidified, and then taken out from the mold. In producing a cast article of complicated shape, a mold having a cavity provided with gates and feeders, and a core to be disposed in the cavity to provide a space defining the thickness of the cast article have been commonly made of a kneaded mixture of a mold sand and an organic binder. The organic binder exemplified by urethane resin, furan resin, polyester resin, etc. is partially decomposed when exposed to a high-temperature molten metal.

Since the molten metal shrinks during solidification in the mold cavity, a portion of fresh molten metal should be fed to make up for the shrinkage. However, since the fresh molten metal cannot be fed to an isolated non-solidified metal completely surrounded by solidified metal, porosity defects such as a cavity and other void regions are formed therein as a result of shrinkage of molten metal. The cavity thus formed is called a shrinkage cavity which is one of the serious casting defects.

Therefore it is important for producing a sound cast article to employ casting parameters including material properties, geometry of mold, mold cavity, etc. and process variables, which can avoid the formation of a shrinkage cavity. The formation of a shrinkage cavity depends on the shapes of the mold cavity, gate and feeder, molten metal temperature, gas content in the molten metal, etc. Since these factors are closely related to each other, it has been practically difficult to predict the formation of shrinkage cavity.

Further, it is desired for reducing the production cost to minimize the number of runners through which the molten metal flows into the mold cavity from the molten metal bath, and the amount of the molten metal stored in the feeders to compensate for the solidification shrinkage. However, there is a problem that the probability of formation of a shrinkage cavity increases with the decrease in the number of runners and feeders.

In order to predict and evaluate the formation of shrinkage cavity, a solidification simulation method called "hot spot method" has been proposed. In this method, it is judged whether or not a molten metal island (a non-solidified metal surrounded by solidified metal) referred to as a hot spot is formed in a solidifying metal.

The solidification simulation method conventionally employed will be described below with reference to the flowchart shown in FIG. 1. First, the geometrical shape of a cast article is divided into a plurality of element meshes (step A), and the material properties and the process variables of casting are assigned as the initial conditions (step B). After a predetermined time increment ($\Delta t$), the liquid fraction ($f_L$) in each element in successive predetermined time increments ($\Delta t$) is computed (step C). The computation of the liquid fraction ($f_L$) is repeated until the completion of the solidification of molten metal (step D). When the heat flow in the cast article and the mold is expressed by a two-dimensional field, the relationship between the liquid fraction ($f_L$) and the temperature (T) of a certain element at computer calculation is expressed by the following equation (1):

$$C\rho(\delta T/\delta t)=\lambda(\delta^2 T/\delta x^2+\delta^2 T/\delta y^2)-\rho L(\delta f_L/\delta t) \quad (1)$$

wherein C is a specific heat, $\lambda$ is a thermal conductivity, $\rho$ is a density (average density of solid and liquid phase) and L is a latent heat of solidification.

When the results of the computation indicate the presence of an element having a high liquid fraction ($f_L$), which is completely surrounded by elements of low liquid fraction ($f_L$), it may be predicted that a void region (porosity defects) such as a shrinkage cavity is likely to be formed in the surrounded element due to the solidification shrinkage. Thus, the conventional computer simulation of solidification predicts the occurrence of a hot spot which causes a void region based on the computed change of the liquid fraction of each element.

Although the conventional simulation method of solidification can predict the occurrence of void regions with a certain degree of accuracy, it has been found by the inventor that a void region is sometimes formed even under the computed condition predicting no void region formation. This means that the hot spot method taking only temperature calculations into consideration is limited in its accuracy for predicting porosity formation.

OBJECT AND SUMMARY OF THE INVENTION

Accordingly, an object of the present invention is to provide a computer simulation method of solidification for optimizing the casting parameters to prevent the occurrence of porosity defects during the solidification of molten metal. More particularly, the object of the present invention is to provide a computer simulation method for selecting optimum combinations of the gas content of molten metal, the mold materials, feeder designs and runner designs.

As a result of the intense research in view of the above object, the inventor has found that the formation of porosity in a solidifying metal can be accurately predicted from pressure gradients of the interdendritic molten metal present in the liquid/solid coexisting zone, and a gas pressure in the molten metal, both calculated by simulating the solidification of molten metal. The present invention has been accomplished by this finding.

Thus, in an aspect of the present invention, there is provided a method of numerically predicting occurrence of porosity defects in producing a cast article by solidifying a molten metal introduced into a mold cavity equipped with at least one feeder and gate and formed in a mold, comprising the steps of (1) dividing the mold and the mold cavity into a plurality of elements; (2) providing each of the elements with material properties of mold and casting metal, and process variables as initial data; (3) calculating a liquid fraction of each of the elements in successive predetermined time increments to examine whether nor not each of the elements is in a solid-liquid coexisting zone; (4) calculating pressure gradients between each of the elements in the solid-liquid coexisting zone and neighboring elements thereof by numerically analyzing an interdendritic flow of the molten metal; (5) calculating gas pressure in the molten metal in each of the elements in the solid-liquid coexisting zone; (6) comparing the gas pressure with an equilibrium pressure, and calculating a porosity amount for each of the elements in the solid-liquid coexisting zone where the gas pressure is higher than the equilibrium pressure; and (7)

repeating the calculations of the steps (3) to (6) until the solidification of the molten metal is completed.

DETAILED DESCRIPTION OF THE INVENTION

Figure 2:
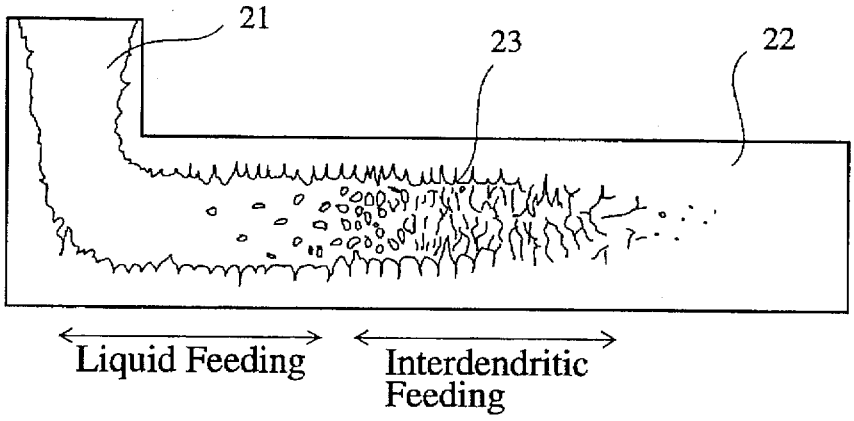
FIG. 2 is a schematic view showing dendritic solidification of molten metal.
Figure 3:
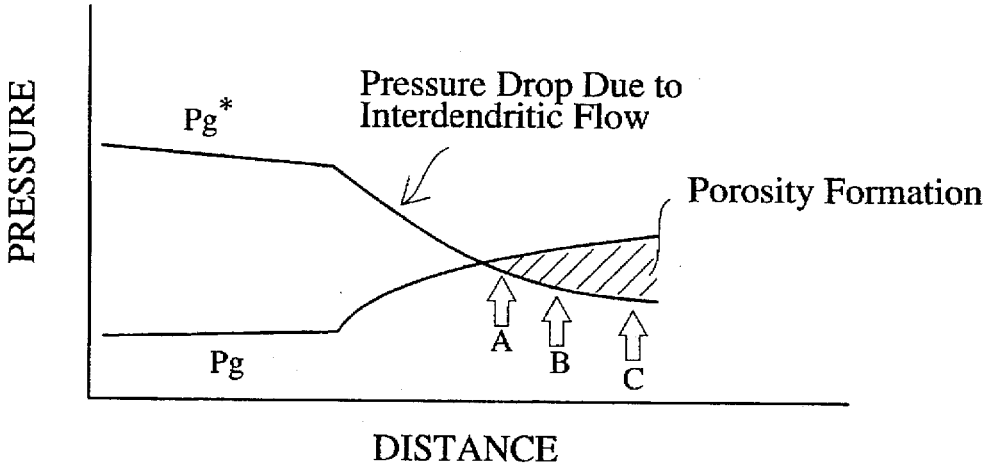
FIG. 3 is a schematic view showing the growth process of porosity formation in solidifying metal.
Figure 3:
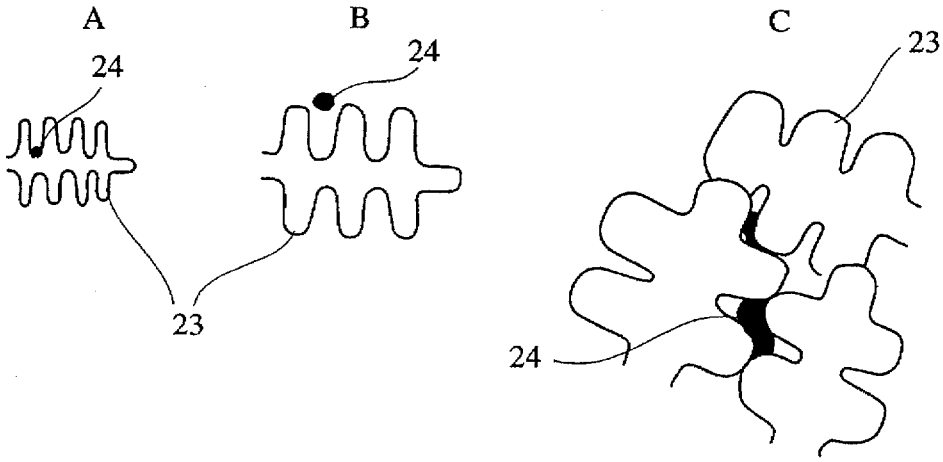

The growth process of porosity formation is shown in FIG. 2 and FIG. 3 which figures are quoted from K. Kubo and R. D. Pehlke, Metallurgical Transaction 16B, pp 359–366 (1983). A molten metal 21 poured into a mold cavity starts to solidify from periphery portion contacting with the inner mold wall to generate a solidified phase 22 which mainly comprises a grown dendrite phase 23. The molten metal remaining in the interdendritic space flows with the growth of dendrite phase 23.

The pressure drop in the equilibrium pressure (Pg*) during the interdendritic flow of the molten metal and the increasing of the gas pressure (Pg) in molten metal bear a relationship as shown in the graph of FIG. 3. As the solidification of the molten metal proceeds, the dendrite phase 23 grows to cause the interdendritic flow of the molten metal 21. As the solidification proceeds further, the pressure of the molten metal drops due to the interdendritic flow to decrease the equilibrium pressure (Pg*), and the gas pressure (Pg) in the remaining molten metal increases. In a later stage of solidification, if the interdendritic feeding of molten metal 21 is not sufficient, the gas pressure (Pg) in the molten metal becomes higher than the equilibrium pressure (Pg*) to result in the generation of porosity 24. The formation of porosity has been considered to occur mainly following the above mechanism.

Since the conventional solidification simulation has taken only the heat balance into consideration, the results of simulation are not necessarily in good agreement with the experimental results. As mentioned above, the present inventor has found that the formation and the amount of porosity can be predicted far more accurately from the calculated gas pressure in the molten metal, calculated pressure gradients of the interdendritic molten metal, and the comparison of the gas pressure with the equilibrium pressure. More specifically in the present invention, the porosity formation is predicted from the solutions to the continuity equation and the motion equation (Darcy's law) for the interdendritic flow of the molten metal, the equilibrium equation of pressure, and the balance equation of gas content.

Figure 4:
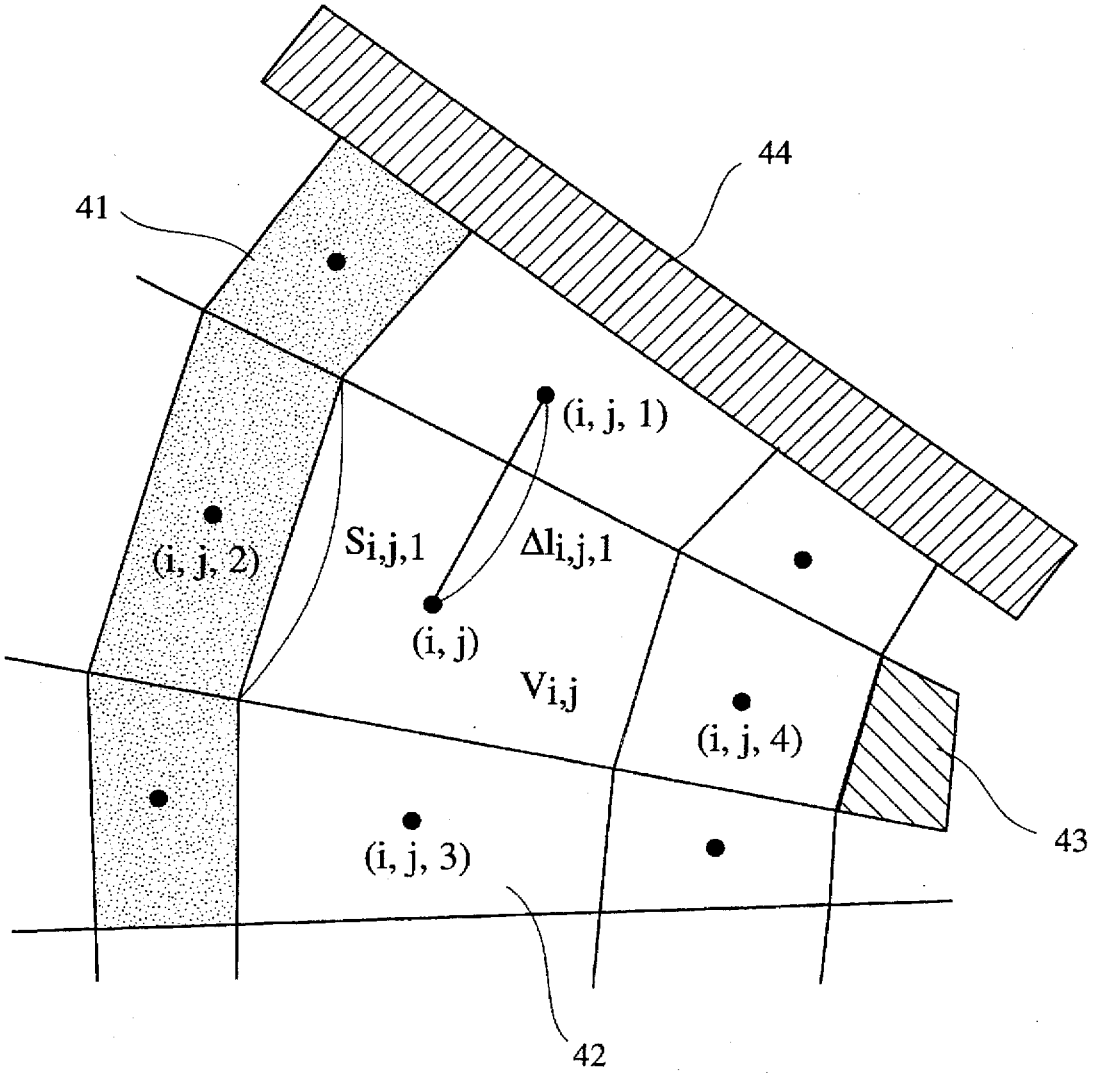
FIG. 4 is a schematic view illustrating the mold and the mold cavity divided into a plurality of elements by non-orthogonal mesh.

The solidification simulation of the present invention requires input data in the form of discrete elements which define the geometry of the mold cavity and the mold, along with material constants and process variables. The solidification process of the molten metal is mathematically simulated by a direct finite difference method in which the mold and the mold cavity are divided by non-orthogonal mesh into a plurality of elements of different size. Simulations of solidification by this direct finite difference method are preferable when an accurate geometrical representation is required because arbitrarily shaped elements can be used as shown in FIG. 4. In FIG. 4, for example, a certain element (i,j) of the molten metal 42 in the mold 41 is surrounded by four elements (i,j,1), (i,j,2), (i,j,3) and (i,j,4). The reference numerals 43 and 44 depict a cooling water and a heat insulator, respectively. The heat transfer ΔT through each inter-element interface is calculated from $$\Delta T=\Sigma\{\alpha_{i,j,m}S_{i,j,m}\Delta t/V_{ij}\rho C\}\cdot(T_{i,j,m}-T_{i,j}) \quad (2)$$

wherein the definition for each of α, S, t, V, ρ and C is given in Table 1.

Figure 5A:
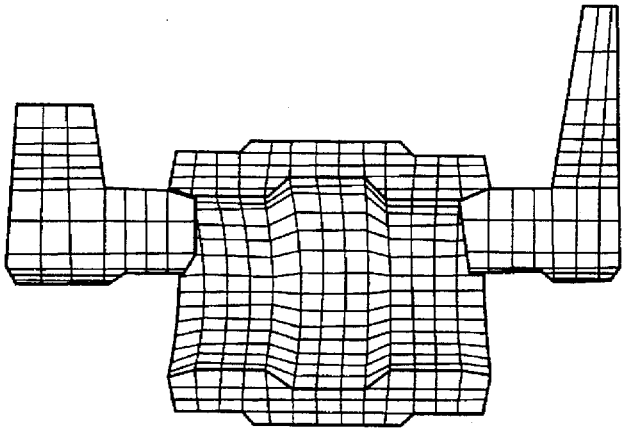
FIGS. 5A–5C are schematic views showing a piping part divided by non-orthogonal mesh.
Figure 5B:
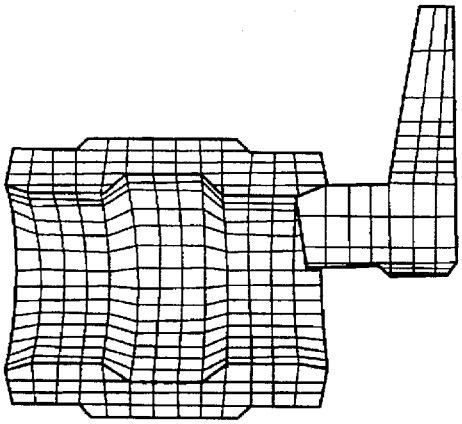
Figure 5C:
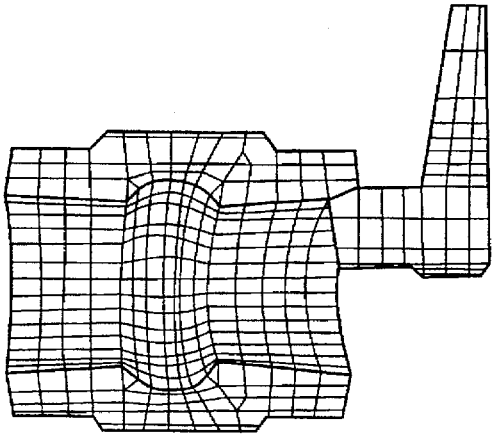

The details of the present simulation method will be described below with reference to the specific example of casting a piping part as shown in FIGS. 5A–5C. However, it should be noted that the present invention is applicable to any other shapes of cast articles for optimizing the casting parameters.

Figure 1:
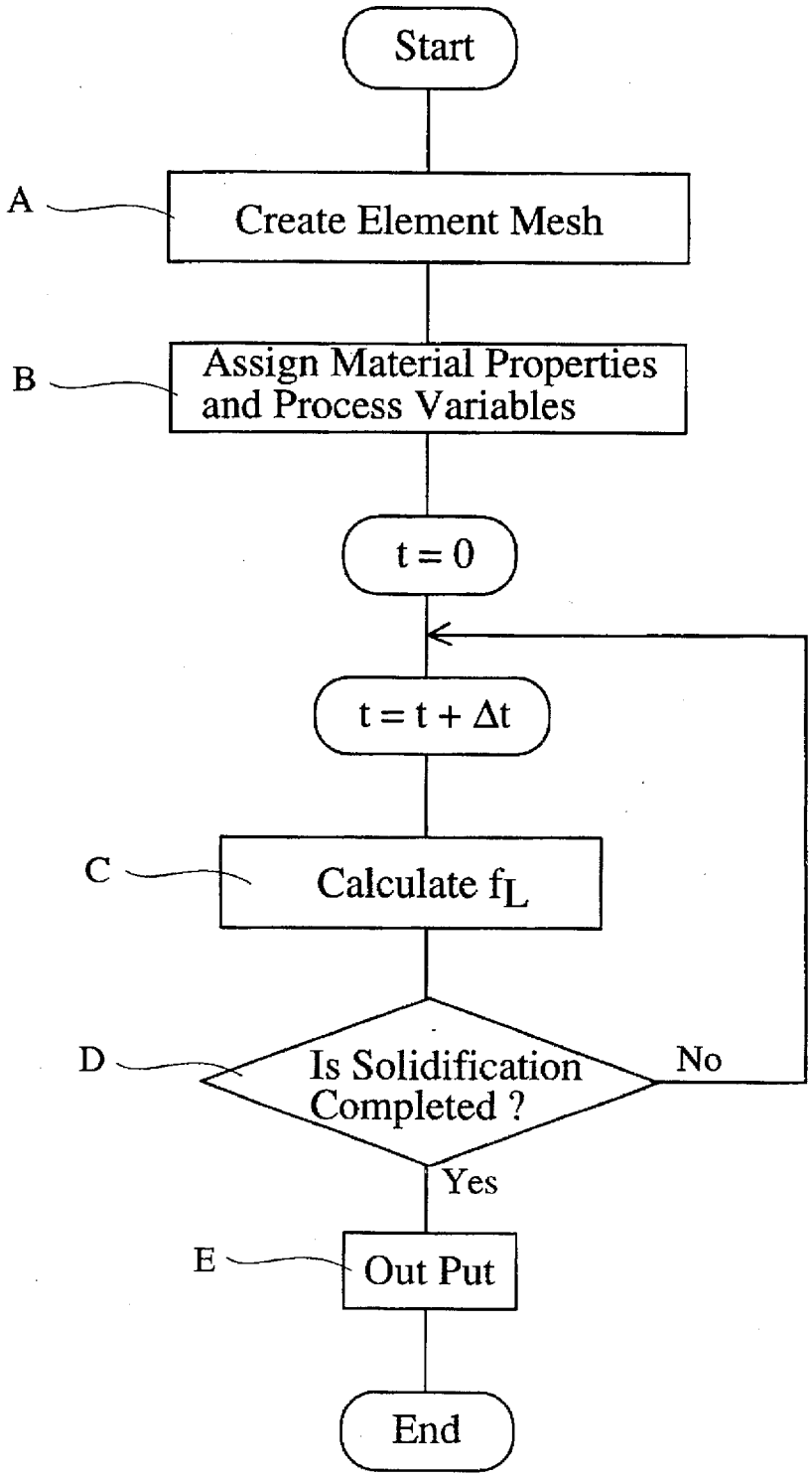
FIG. 1 PRIOR ART
FIG. 1 is a flowchart of the conventional solidification simulating method.
Figure 6:
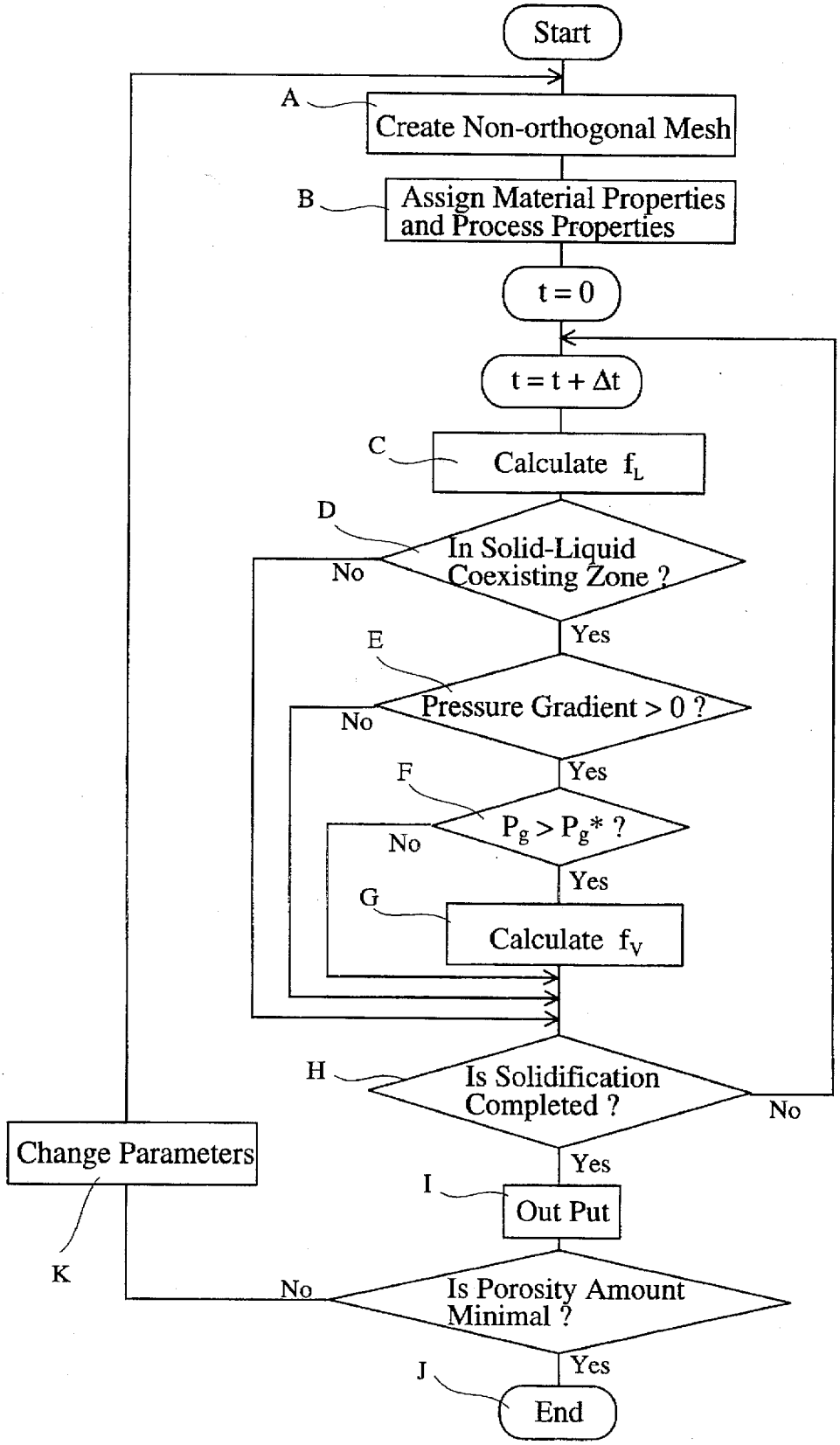
FIG. 6 is a flowchart of computer simulation of the present invention for calculating porosity formation.
Figure 7A:
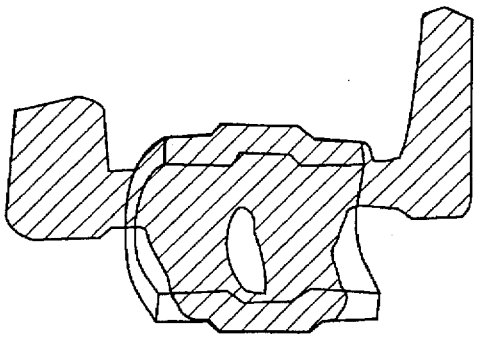
FIG. 7A PRIOR ART
FIGS. 7A–7D, 8A–8D, 9A–9D are schematic views showing the temperature change of molten metal in casting joints with one or two gates simulated by the conventional method.
Figure 7B:
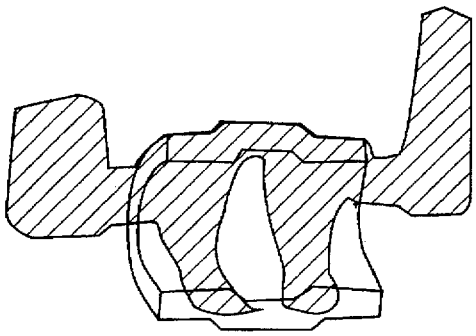
FIG. 7B PRIOR ART
Figure 7C:
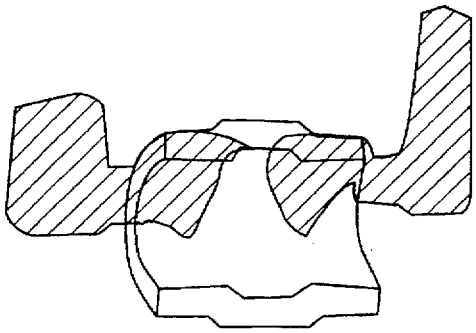
FIG. 7C PRIOR ART
Figure 7D:
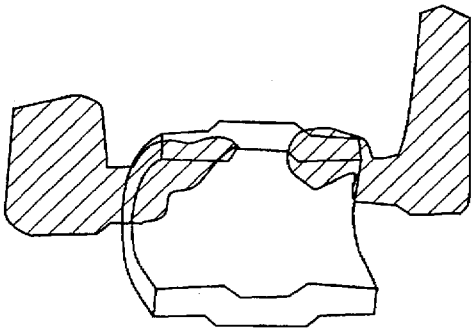
FIG. 7D PRIOR ART
Figure 8A:
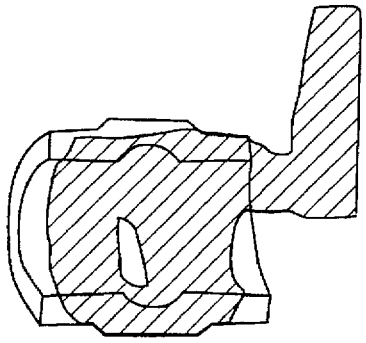
FIG. 8A PRIOR ART
Figure 8B:
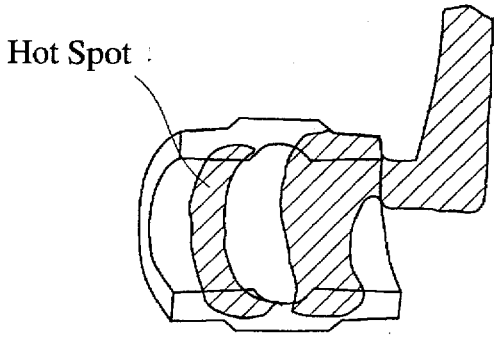
FIG. 8B PRIOR ART
Figure 8C:
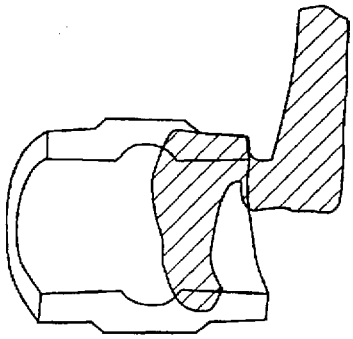
FIG. 8C PRIOR ART
Figure 8D:
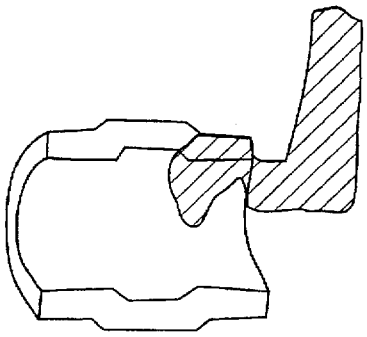
FIG. 8D PRIOR ART
Figure 9A:
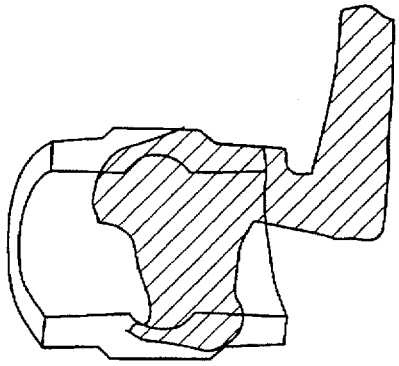
FIG. 9A PRIOR ART
Figure 9B:
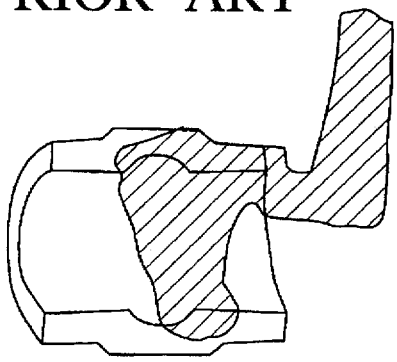
FIG. 9B PRIOR ART
Figure 9C:
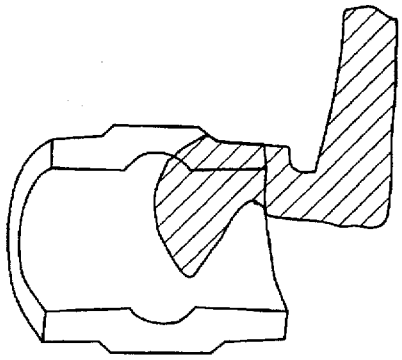
FIG. 9C PRIOR ART
Figure 9D:
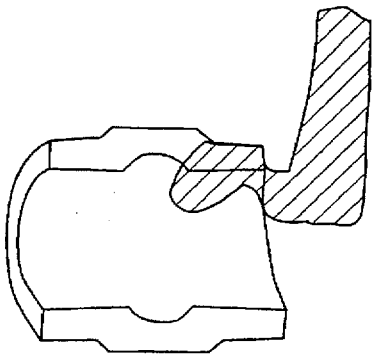
FIG. 9D PRIOR ART

A flowchart for the calculation algorithm is shown in FIG. 6. From comparison of FIG. 6 with FIG. 1 showing the conventional simulation, it would appear that the simulation method of the present invention includes additional steps not employed in the conventional method, namely, a step of calculating the pressure gredients of the interdendritic molten metal and a step of examining the porosity formation by comparing the gas pressure (Pg) in the molten metal and the equilibrium pressure (Pg*).

(a) Creation of the non-orthogonal mesh (Step A)

Of the casting parameters which significantly affect the occurrence of porosity defects, the geometry of a cast article (mold cavity) and a feeder is most important. The effects of the geometry of the cast article and the feeder on solidifying metals can be analyzed by finite difference method. FIGS. 5A–5C are schematic views showing three-dimensional geometry of a cast articles for a piping part (joint) spatially divided by hexahedral elements and wedge elements. FIGS. 5(A), 5(B) and 5(C) are a joint with two gates, a joint with one gate, and a joint with one gate having a modified geometry, respectively. Regardless of the use of hexahedral elements and wedge elements in FIG. 5, tetrahedral elements could also be used.

(b) Assignment of material constants and process variables (Step B)

The requisite data to be input are properties of the casting materials and mold materials, and accurate process variables such as molten metal temperature, gas content in the molten metal, etc., which are employed in practicing the actual casting. Such data may include the parameters shown in the following Table 1.

TABLE 1

| Nomenclature | | Unit |
|---|---|---|
| C | specific heat of casting metal | cal/g · °C. |
| $f_L$ | liquid fraction of each element | — |
| $k_{NL}$ | equilibrium constant of nitrogen in liquid phase | $5.8 \times 10^5$ Pa/ppm$^2$ |
| $f_v$ | porosity amount of each element | % |
| g | gravity vector (y component) | 980 cm/s$^2$ |
| k | permeability (flowability of interdendritic molten metal) | cm$^2$ |
| L | latent heat of solidification of casting metal | cal/g |
| P | molten metal pressure | Pa |
| $P_g$ | gas pressure in molten metal | Pa |
| $P_g$* | equilibrium pressure (gas pressure balanced by the gas pressure in porosity) | Pa |
| r | radius of porosity | cm |
| S | area of element | cm$^2$ |
| T | temperature of each element | °C. |
| t | time | s |
| u | velocity of molten metal in x direction | cm/s |
| V | volume of element | cm$^3$ |
| v | velocity of molten metal in y direction | cm/s |
| x | distance in x direction | cm |
| y | distance in y direction | cm |
| Δl | inter-element distance | cm |
| Δt | time increment | s |
| α | heat transfer coefficient | cal/s · cm$^2$ · °C. |
| ρ | average density of liquid phase and solid phase | g/cm$^3$ |
| $\rho_S$ | density of solid phase | g/cm$^3$ |
| $\rho_L$ | density of liquid phase | g/cm$^3$ |
| λ | thermal conductivity of casting metal | cal/cm · s · °C. |
| μ | viscosity of molten metal | g/cm · s |
| $\sigma_{LG}$ | liquid-gas interfacial energy | dyn/cm |
| $[N_0]$ | initial nitrogen content in molten metal | ppm |
| $[N_S]$ | nitrogen content in solid phase | ppm |
| $[N_L]$ | nitrogen content in remaining liquid phase | ppm |

(c) Calculation of heat transfer (Step C)

First, the temperatures of the mold and the mold cavity are calculated by a temperature recovery method. The heat transfer between the cast article and the mold by means of two-dimensional field is expressed as $$C\rho(\delta T/\delta t)=\lambda(\delta^2T/\delta x^2+\delta^2T/\delta y^2)-\rho L(\delta f_L/\delta t) \quad (1)$$

The liquid fraction ($f_L$) for each element is calculated from the equation (1) as a function of the temperature (T).

(d) Examining whether or not the element is in solid-liquid coexisting zone (Step D)

When $f_L$−1, the element is in fully liquid zone, and in fully solid zone when $f_L$=0. In both the cases, the judgment is made on whether or not the solidification of the molten metal is completed. When $0<f_L<1$, the element is in the solid-liquid coexisting zone, and the judgment is proceeded to the next step E.

(e) Calculation of pressure gradients of interdendritic molten metal (Step E)

The interdendritic molten metal flow is expressed by the following continuity equation (3):

$$(\rho_S/\rho_L-1)(\delta f_L/\delta t)-(\delta f_L u/\delta x)-(\delta f_L v/\delta y)+(\delta f_v/\delta t)=0 \quad (3)$$

The motion (u,v) describing the interdendritic flow of the molten metal is expressed by the following motion equations (4) and (5):

$$u=-(k/\mu)(\delta P/\delta x) \quad (4)$$

$$v=-(k/\mu)(\delta P/\delta y)-(k\rho g/\mu f_L) \quad (5)$$

wherein the direction of gravity acceleration is assumed to be directed to y direction.

The pressure field of the solid-liquid coexisting zone is calculated by simultaneously solving the equations (3) to (5), each substituted with the calculated value of $f_L$ from the equation (1). Next, the pressure gradients from a certain element toward the four neighboring elements as a result of interdendritic molten metal flow are summated. When the summation is positive as shown in the equation (6), the molten metal in the element receives an effusive force to suggest the formation of porosity. When the summation is positive on an certain element (i,j), the judgment proceeds to the next step F, and the judgment is made as to whether or not the solidification of the molten metal is completed when the summation is negative.

$$\Sigma\{(P_{i,j}-P_{i,j,m})/\Delta 1_{i,j,m}\}>0 \quad (6)$$

wherein the summation is made from m=1 to m=4.

(f) Calculation of gas pressure and equilibrium pressure in molten metal and comparison thereof (Step F)

The equilibrium pressure ($P_g$*) of the molten metal is related to the molten metal pressure (P) and the liquid-gas interfacial energy ($\sigma_{LG}$) as $$P_g^*=P+(2\sigma_{LG}/r) \quad (7)$$

wherein the radius of porosity (r) is assumed to be half the size of a secondary dendrite arm.

The gas content balance of nitrogen gas is expressed as $$[N_0]=(1-f_L)[N_S]+f_L[N_L] \quad (8)$$

Since the nitrogen content in solid phase ($[N_S]$) is too small as compared with the nitrogen content in the remaining liquid phase ($[N_L]$), the term including $[N_S]$ can be neglected.

The nitrogen gas in liquid phase is in equilibrium with the nitrogen gas in porosity, and therefore, the following equation is derived.

$$P_g=k_{NL}[N_L]^2 \quad (9)$$

The gas pressure ($P_g$) in the molten metal is calculated from the equations (8) and (9). When the gas pressure ($P_g$) is higher than the equilibrium pressure ($P_g$*) calculated from the equation (7), porosity formation occurs. On the other hand, when the comparison indicates $P_g \leqq P_g^*$, porosity formation does not occur.

(g) Calculation of porosity amount (Step G)

When porosity has already formed ($P_g>P_g^*$) in a certain element, the amount of porosity ($f_v$) in the element is calculated by the continuity equation (3).

(h) Examining completion of solidification (Step H)

The completion of solidification of the molten metal is judged by the liquid fraction ($f_L$). When $f_L$=0, the solidification is completed. When $0<f_L$, the steps C to G are repeated in successive time increments until the liquid fraction ($f_L$) reaches zero. Upon completion of the above series of computer calculations for a given time increment, sufficient data on the formation of porosity (the number and distribution of porosity) in a cast article are available.

(i) Output of computer simulation results (Step I)

The output of the calculation results may be directed to a display, a printer, or other output devices. It is preferable to graphically display the results with colored porosity images because the porosity locations can be easily identified with the eye.

(j) Judgment of porosity amount (Step J)

The judgment of porosity amount in the cast article is made by examining the simulation results. If the amount is nearly zero and not considerable, then the optimization of casting parameters is successful. If the results indicate porosity formation of a considerable amount, the simulation proceeds to the next step for minimizing the porosity amount.

(k) Repetition with modified parameters until the porosity amount is minimized (Step K)

When the results of the steps of A to H indicate porosity formation of a considerable amount, the procedure of the steps A to H is repeated over each element and each time step with at least one casting parameters modified until the porosity amount is minimized to reach an optimized casting parameters such as material constants, process variables and design geometry. The casting parameters to be modified may include design geometry of mold cavity, gate and feeder, temperature of molten metal, gas content in molten metal, etc.

The present invention will be further described while referring to the following Examples which should be considered to illustrate various preferred embodiments of the present invention.

EXAMPLE 1 AND COMPARATIVE EXAMPLE 1

The casting process of malleable joint with one or two gates was simulated by the conventional method as shown in FIG. 1 and the inventive method shown in FIG. 6. The physical properties of metal are shown in Table 2.

TABLE 2

| Simulation Parameters | |
|---|---|
| C | 0.20 cal/g · °C. |
| L | 50.0 cal/g |
| $\lambda$ | 0.085 cal/cm · s · °C. |
| $\mu$ | 0.071 g/cm · s |
| $\rho$ | 6.8 g/cm$^3$ |
| $\rho_S$ | 6.9 g/cm$^3$ |
| $\rho_L$ | 6.7 g/cm$^3$ |
| $\sigma_{LG}$ | 1840 dyn/cm |
| $[N_0]$ | 60 ppm and 70 ppm |

The permeability (k) was calculated from the following equations according to the value of the liquid fraction ($f_L$):

$$k = 0.1^3 d_2^2/(180 \times 0.1^2) \quad [f_L \leqq 0.1],$$

$$k = f_L^3 d_2^2/(180 \times (1 - f_L)^2) \quad [0.1 < f_L \leqq 0.7], \text{ and}$$

$$k = 0.1^3 d_2^2/(180 \times 0.1^2) \quad [0.7 < f_L \leqq 1]$$

wherein $d_2$ is a size of secondary dendrite arm calculated from the following equations:

$$d_2 = 0.71 \times (\text{cooling rate})^{0.39}, \text{ and}$$

$$(\text{cooling rate}) = (T1 - T)/\Delta t_f$$

wherein T1 is a solidification initiating temperature, T is a temperature at the time of measurement, and $\Delta t_f$ is a time elapsed since the solidification is started.

The results of solidification simulation by the conventional method are shown in FIGS. 7A–7D, 8A–8D, 9A–9D. In each of FIGS. 7A–7D, 8A–8D, 9A–9D, the molten metal temperature changes in the order of (A), (B), (C) and (D), and the hatched portion shows non-solidified metal. In FIGS. 7A–7D (joint with two gates), hot spot occurred only in the feeder, whereas in the joint with one gate of FIGS. 8A–8D, a large hot spot occurred in the article body, which predicted the formation of a large amount of porosity defects. In the joint with modified geometry of FIGS. 9A–9D, there was no occurrence of hot spot in the article body, and therefore, a sound cast article was expected to be produced. However, actual casting of the joint with modified geometry as shown in FIGS. 9A–9D provided both sound cast articles and cast articles having porosity defects. Thus, the conventional method could not accurately and directly predict the occurrence of porosity defects.

Figure 10A:
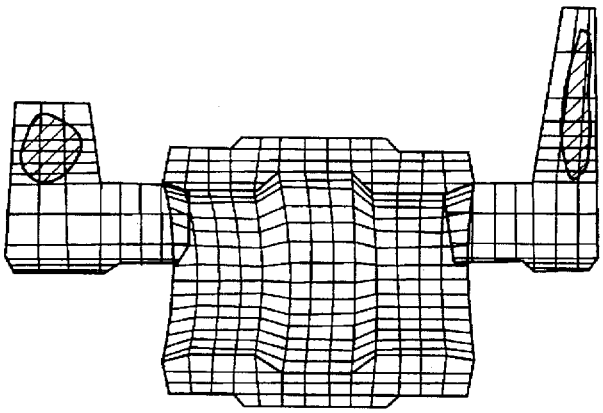
FIGS. 10A–10C and 11A–11C are schematic views showing the results of computer calculation of porosity amount in cast joints with one or two gates simulated by the method of the present invention.
Figure 10B:
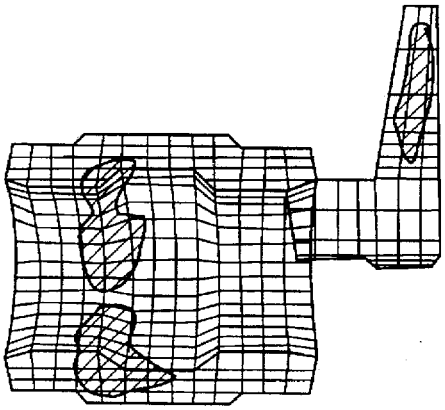
Figure 10C:
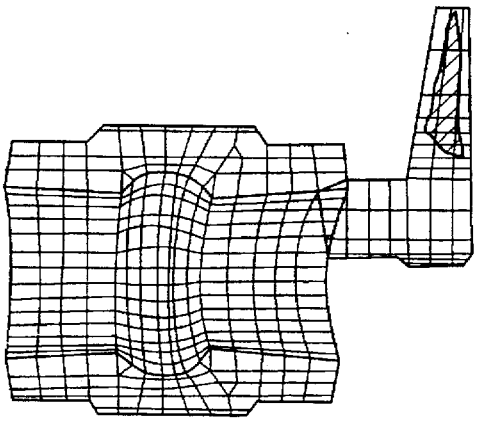
Figure 11A:
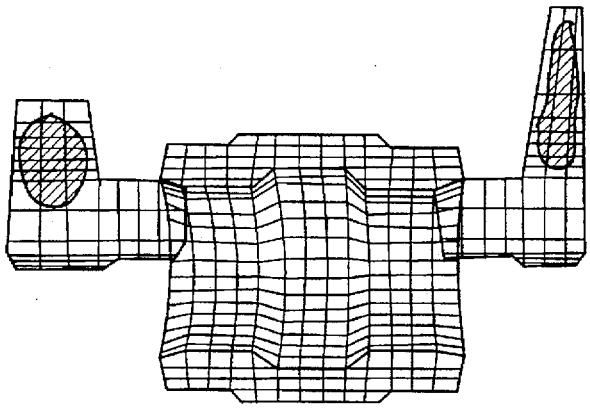
Figure 11B:
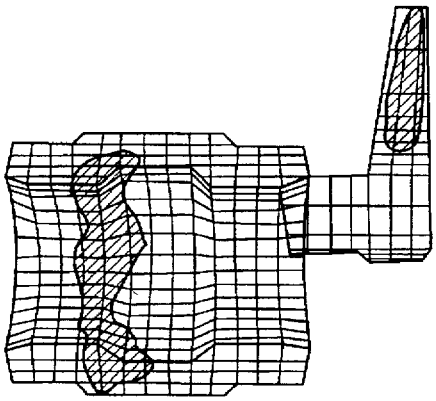
Figure 11C:
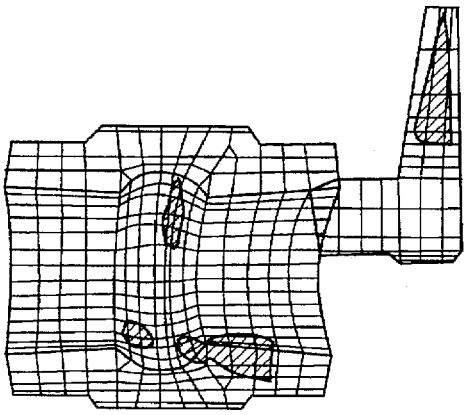

The results of the inventive method are shown in FIGS. 10A–10C and 11A–11C, in which the hatched portion is a porosity region having 1% or more of the porosity amount ($f_V$), and the initial nitrogen content is 60 ppm for FIG. 10 and 70 ppm for FIGS. 11A–11C. In the joint with two gates, porosity formation was predicted to occur only in the feeder despite the change in the initial nitrogen content (FIGS. 10(A) and 11(A)), whereas predicted to occur in the article body in both the initial nitrogen content in the case of the joint with one gate (FIGS. 10(B) and 11(B)). In the case of the joint with modified geometry, porosity occurrence in the article body was not predicted when the initial nitrogen content was 60 ppm, while predicted when 70 ppm (FIGS. 10(C) and 11(C)). These calculated results were in excellent agreement with experimental results. Thus, the inventive method could accurately and directly predict the formation of porosity defects.

As described above, the conventional method fails to predict the occurrence of porosity defects in some cases. In the method of the present invention, the effects of the interdendritic flow of the remaining molten metal is also taken into consideration, and therefore, the occurrence of porosity defects can be accurately and directly predicted.

Since the occurrence of porosity defects is directly predicted, the method of the present invention is independent from the kind of casting materials. According to the method of the present invention, it is possible to easily and effectively optimizing a casting parameters for producing cast articles, which are light in weight, highly reliable in qualities, and high in precision, for use as automobile parts.

What is claimed is:

1. A method of numerically predicting occurrence of porosity defects in producing a cast article by solidifying a molten metal introduced into a mold cavity equipped with at least one feeder and gate and formed in a mold, comprising the steps of:

(1) dividing said mold and said mold cavity into a plurality of elements;

(2) providing each of said elements with material properties of casting metal and mold, and process variables as initial data;

(3) calculating a liquid fraction of each said elements in successive predetermined time increments to examine whether or not each of said elements is in a solid-liquid coexisting zone;

(4) calculating pressure gradients between each of said elements in said solid-liquid coexisting zone and neighboring elements thereof by numerically analyzing an interdendritic flow of said molten metal;

(5) calculating gas pressure in said molten metal in each of said elements in said solid-liquid coexisting zone;

(6) comparing said gas pressure with an equilibrium pressure, and calculating a porosity amount for each of said elements in said solid-liquid coexisting zone where said gas pressure is higher than said equilibrium pressure; and (7) repeating said calculations of the steps (3) to (6) until the solidification of said molten metal is completed.

2. The method according to claim 1, wherein said step (1) includes dividing said feeder and said gate into a plurality of elements.

3. The method according to claim 1, wherein said process variables include a molten metal temperature, a molten metal pressure and a gas content in said molten metal.

4. The method according to claim 1, further comprising a step (8) of examining whether or not said porosity amount is minimal after said step (7).

5. The method according to claim 4, wherein if said porosity amount is not minimal, said steps (1) to (8) are repeated with at least one of shapes of said mold cavity, feeder and gate, and said initial data modified until said porosity amount is minimized.

6. The method according to claim 5, wherein said initial data modified include a molten metal temperature, and a gas content in said molten metal.

* * * * *